US006559836B1

(12) United States Patent
Mori

(10) Patent No.: US 6,559,836 B1
(45) Date of Patent: May 6, 2003

(54) SOURCE DRIVER FOR LIQUID CRYSTAL PANEL AND METHOD FOR LEVELING OUT OUTPUT VARIATIONS THEREOF

(75) Inventor: Shinichiroh Mori, Kusatsu (JP)

(73) Assignee: International Business Machines Corporation, Armonk, NY (US)

( * ) Notice: Subject to any disclaimer, the term of this patent is extended or adjusted under 35 U.S.C. 154(b) by 199 days.

(21) Appl. No.: 09/639,988

(22) Filed: Aug. 16, 2000

(30) Foreign Application Priority Data

Jan. 5, 2000 (JP) ..... 2000-005290

(51) Int. Cl.[7] ..... G09G 5/00; G09G 3/36
(52) U.S. Cl. ..... 345/204; 345/100
(58) Field of Search ..... 345/531, 204, 345/100; 327/72; 324/177; 315/379

(56) References Cited

U.S. PATENT DOCUMENTS 4,710,766 A * 12/1987 Dubois et al. ..... 345/531
4,845,382 A * 7/1989 Eouzan et al. ..... 327/72
6,008,801 A * 12/1999 Jeong ..... 345/204
6,014,122 A * 1/2000 Hashimoto ..... 345/98
6,081,112 A * 6/2000 Carobolante et al. ..... 324/177
6,208,094 B1 * 3/2001 Morrish ..... 315/379

* cited by examiner

*Primary Examiner*—Steven Saras
*Assistant Examiner*—Srilakshmi Kumar
(74) *Attorney, Agent, or Firm*—F. Chau & Associates, LLP; Robert M. Trepp

(57) ABSTRACT

An object of the present invention is to level out variations in output voltage levels caused by the difference in the characteristics of the output amplifiers of a source driver, and to reduce vertical streak noise on the display screen.

A source driver 12 for a liquid crystal panel according to the present invention comprises output amplifier switching means 10 for switching an output amplifier 80, which amplifies analog signal converted from digital image signal by the digital/analog converter 82 and provides the converted analog signal to source lines 74 of a liquid crystal panel 70, to another output amplifier at regular time intervals.

11 Claims, 11 Drawing Sheets

| Counter (high-order bit) | Counter (low-order bit) | SW4CL | SW3CL | SW2CL | SW1CL |
|---|---|---|---|---|---|
| 0 | 0 | 0 | 0 | 0 | 1 |
| 0 | 1 | 0 | 0 | 1 | 0 |
| 1 | 0 | 0 | 1 | 0 | 0 |
| 1 | 1 | 1 | 0 | 0 | 0 |

| | Between DALA and SLA | Between DALB and SLB | Between DALC and SLC | Between DALD and SLD |
|---|---|---|---|---|
| Only SW1 establishes a connection | AmpA | AmpB | AmpC | AmpD |
| Only SW2 establishes a connection | AmpB | AmpC | AmpD | AmpA |
| Only SW3 establishes a connection | AmpC | AmpD | AmpA | AmpB |
| Only SW4 establishes a connection | AmpD | AmpA | AmpB | AmpC |

FIG. 7

SOURCE DRIVER FOR LIQUID CRYSTAL PANEL AND METHOD FOR LEVELING OUT OUTPUT VARIATIONS THEREOF

BACKGROUND OF THE INVENTION

1. Field of the Invention

The present invention relates to a source driver for providing signals to source lines of a liquid crystal panel, and to a method for leveling out variations in source driver outputs.

2. Description of Related Art

FIG. 10 illustrates a configuration of a source driver 72 and an example of its connection with a liquid crystal panel 70. Liquid crystal cells are arranged in a grid pattern in the liquid crystal panel 70. Each liquid crystal cell includes a liquid crystal and a transistor for applying to the liquid crystal cell a voltage corresponding to colors to be displayed.

As shown in FIG. 10, the gate terminals of the transistors of liquid crystal cells arranged in a horizontal line are connected to a gate line 78 arranged in a horizontal direction; and the source terminals of the transistors of liquid crystal cells arranged in a vertical line are connected to a source line 74 arranged in a vertical direction. The gate lines 78 are connected to a gate driver 76 which provides signals sequentially to the gate lines 78. The source lines 74 are connected to a source driver 72 which provides signals to the source lines 74. When a signal is provided from the gate driver 76 to a gate line 78, the transistors (liquid crystal cells) connected to the gate line to which signal is provided are selected. When signals are provided from the source driver 72 to the source lines 74 in this state, the selected transistors (liquid crystal cells) are driven at voltages corresponding to the provided signals.

A configuration of the source driver 72 will be briefly described hereafter. The source driver 72 comprises a shift register 86, buffers A 84, buffers B 85, D/A converters (digital-to-analog converters) 82, and output amplifiers 80. Each source line 74 is provided with a buffer A 84, a buffer B 85, a D/A converter 82, and an output amplifier 80. The buffers A 84 each store gray scale data of the pixels of one horizontal line constituting an image to be displayed on the liquid crystal panel 70. The gray scale data are sequentially stored in the buffers A 84 in accordance with a CLOCK signal with the use of the shift register 86. The gray scale data stored in the buffers A 84 is sent to the buffers B 85 with the use of a LOAD signal. The D/A converter 82 converts the gray scale data (digital signals) of the buffers B 85 into analog signals. The analog signals of the D/A converters 82 are amplified by the output amplifiers 80 to be output to the source lines 74.

FIG. 11 shows an example of a portion including adjacent four output amplifiers in the source driver 72 for the liquid crystal panel shown in FIG. 10. Analog outputs from the D/A converters 82 are input into the four output amplifiers AmpA, AmpB, AmpC, and AmpD through wirings DALA, DALB, DALC, and DALD, respectively. The outputs from the D/A converters 82 are amplified respectively by the four output amplifiers AmpA, AmpB, AmpC, and AmpD, respectively, and output to the source lines SLA, SLB, SLC, and SLD, respectively.

If all the gray scale data sent from the buffers B 85 to the D/A converters 82 are at a uniform level, all the analog voltages converted in the converter 82 are also at a uniform level. Therefore, uniform-level voltages are considered to be provided to all the source lines 74. However, voltage levels may vary depending on offset voltage properties, gain properties, and the like in each output amplifier 80. For this reason, even if the gray scale data of all the pixels are at a uniform level, different voltages are provided to source lines 74. Such voltage level differences causes gray level differences, which may often appear to us to be vertical-streak noise on the liquid crystal panel.

In order to eliminate vertical streak noise, a method of sorting out a source driver having small variations in the characteristics of the output amplifiers may be employed. If the variation in the characteristics of the output amplifiers is small and all the gray scale data are at a uniform level, substantially uniform voltages can be provided to all the source lines 74.

However, the sorting of a source driver having small variations in the characteristics of the output amplifiers leads to the reduction of yields and the increase in costs.

SUMMARY OF THE INVENTION

An object of the present invention is to level out variations in output voltage levels caused by the difference in the characteristics of the output amplifiers of a source driver, and to reduce vertical streak noise on the display screen.

A source driver for a liquid crystal panel according to the present invention comprises output amplifier switching means for switching an output amplifier, which amplifies analog signal and provides it to source lines of a liquid crystal panel, to another output amplifier at regular time intervals. Such a source driver can level out the output variations caused by the difference between individual output amplifiers, by switching among the output amplifiers, which amplify the signal and provide it to the source lines, at regular time intervals.

A method for leveling out output variations in a source driver for a liquid crystal panel according to the present invention comprises an output amplifier switching step for switching an output amplifier, which amplifies analog signal and provides it to source lines of a liquid crystal panel, to another output amplifier at regular time intervals.

BRIEF DESCRIPTION OF THE DRAWINGS

FIG. 7 is a table showing connections of the output amplifiers shown in FIG. 2.

DESCRIPTION OF THE PREFERRED EMBODIMENTS

Embodiments of the present invention will be described in detail below with reference to the accompanying drawings. In this embodiment, four adjacent output amplifiers, which form one group, are selectively switched.

Figure 1:
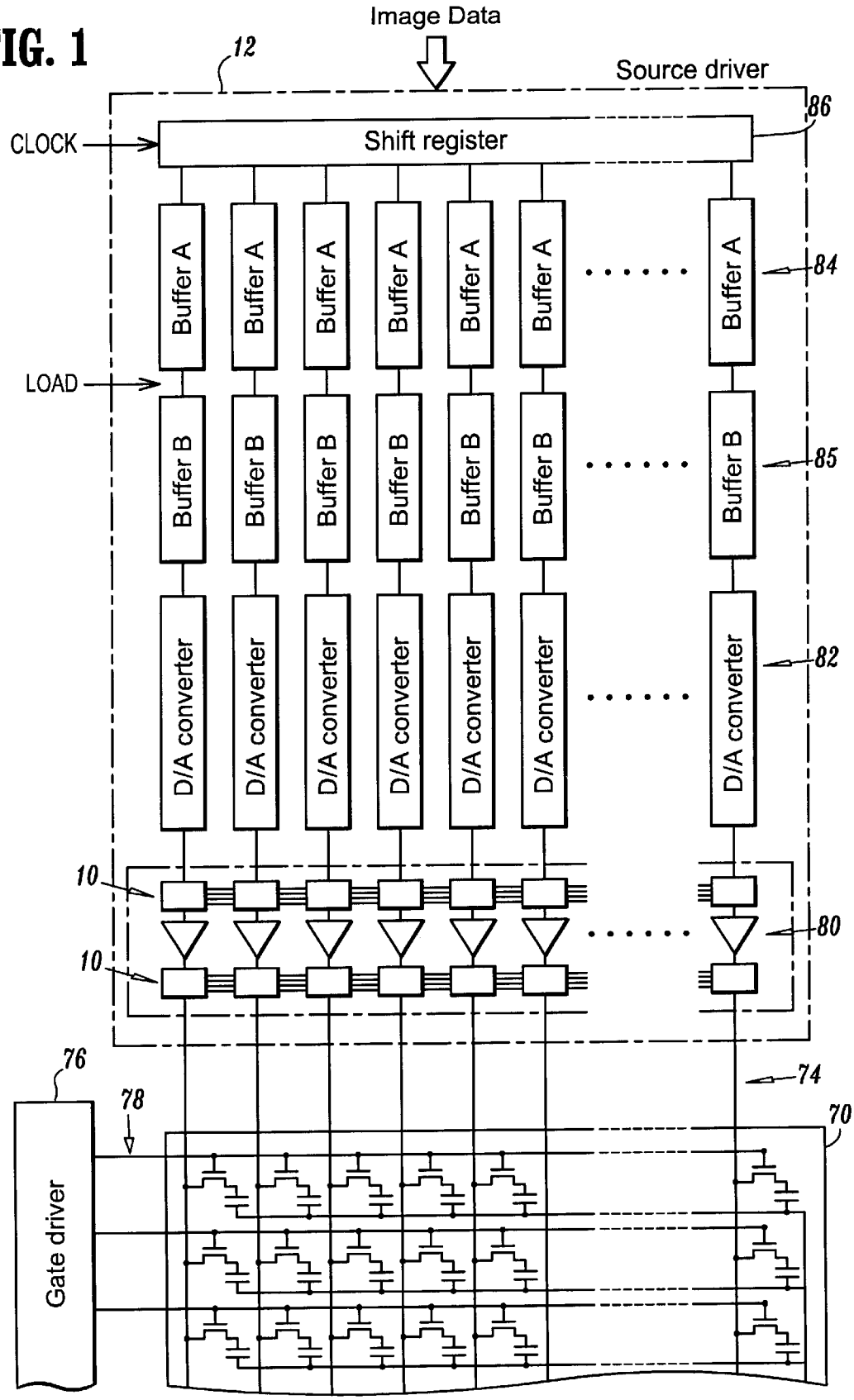
FIGS. 1 is a block diagram showing an example of the source driver for a liquid crystal panel according to the present invention.
Figure 2:
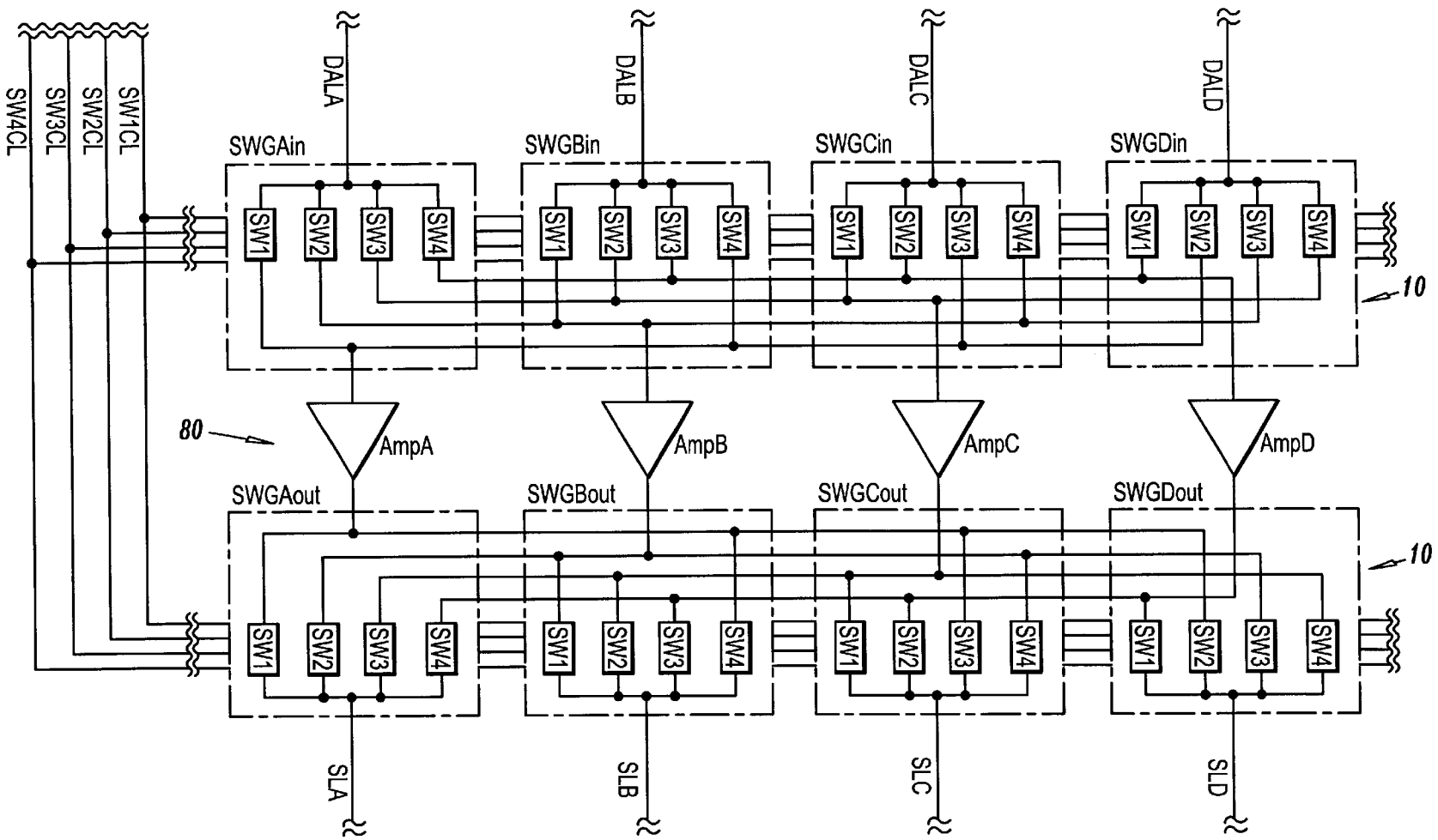
FIG. 2 is a block diagram showing a portion including four adjoining output amplifiers in the source driver shown in FIG. 1.
Figure 11:
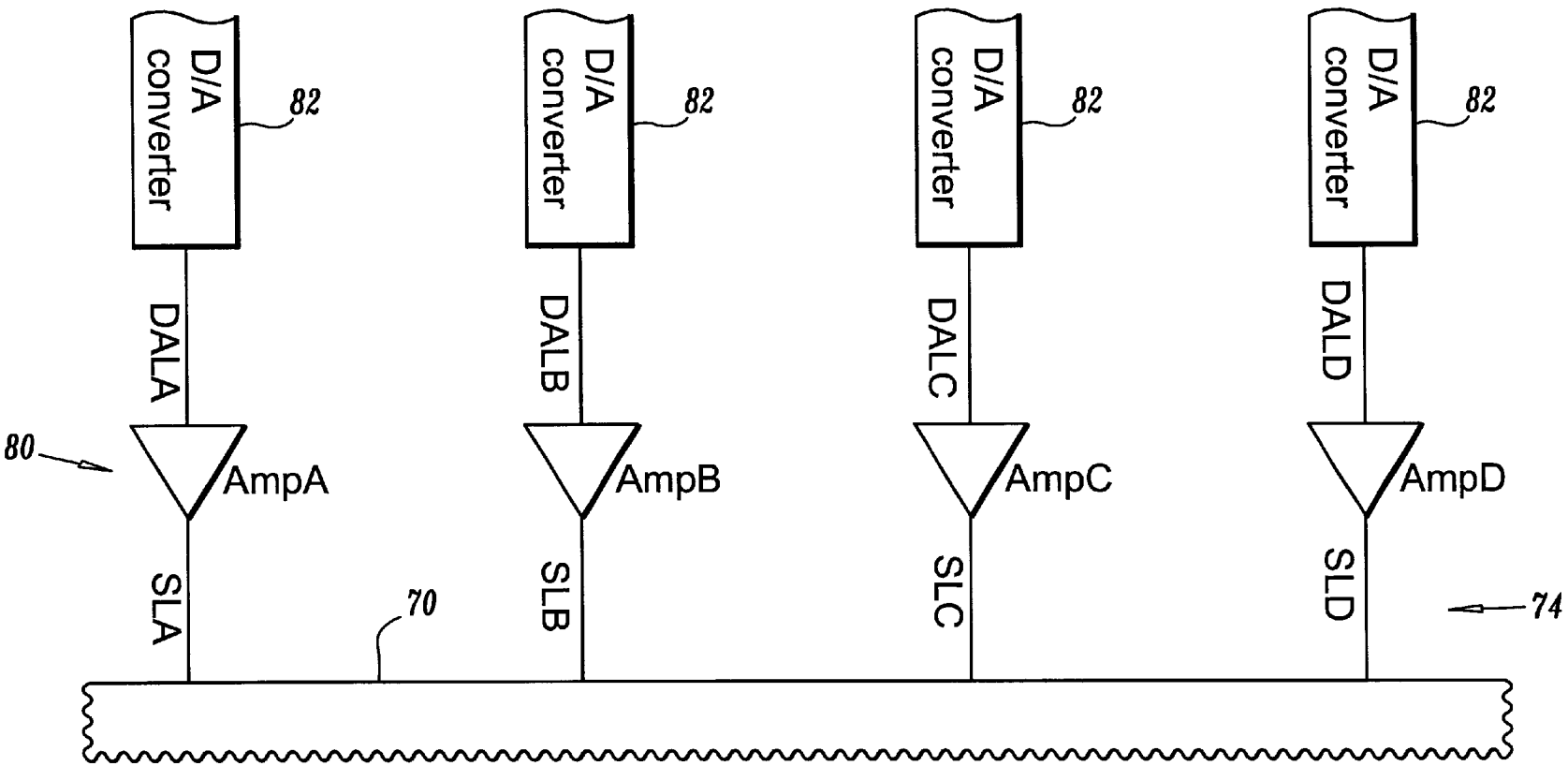
FIG. 11 is a block diagram showing a portion including four adjoining output amplifiers in the source driver shown in FIG. 10.

FIG. 1 shows a source driver 12 for a liquid crystal panel according to the present invention. The diver 12 comprises output amplifier switching means 10 having switch groups of a plurality of connection switches in the input portion and in the output portion. Four output amplifiers, AmpA, AmpB, AmpC, and AmpD shown in FIG. 11 are taken for an example to briefly describe an embodiment of the present invention. As shown in FIG. 2, a switch group SWGAin is placed between a wiring DALA and an amplifier AmpA, while a switch group SWGAout is placed between the amplifier AmpA and a source line SLA. Likewise, switch groups SWGBin, SWGCin, and SWGDin are placed between a wiring DALB and an amplifier AmpB, a wiring DALC and an amplifier AmpC, and a wiring DALD and an amplifier AmpD, respectively, while switch group SWGBout, SWGCout, and SWGDout are placed between the amplifier AMPB and a source line SLB, the amplifier AMPC and a source line SLC, and the amplifier AMPD and a source line SLD, respectively.

Switch groups SWGAin, SWGAout, SWGBin, SWGBout, SWGCin, SWGCout, SWGDin, and SWGDout each comprise connection switches SW1, SW2, SW3, and SW4.

The connection switches SW1, SW2, SW3, and SW4 of the switch group SWGAin connect or interrupt the wiring DALA and the amplifier AmpA, the DALA and the amplifier AmpB, the DALA and the amplifier AmpC, and the DALA and the amplifier AmpD, respectively.

The connection switches SW1, SW2, SW3, and SW4 of the switch group SWGAout connect or interrupt the amplifier AmpA and the source line SLA, the amplifier AmpB and the SLA, the amplifier AmpC and the SLA, and the amplifier AmpD and the SLA, respectively.

The connection switches SW1, SW2, SW3, and SW4 of the switch group SWGB.in connect or interrupt the wiring DALB and the amplifier AmpB, the DALB and the amplifier AmpC, the DALB and the amplifier AmpD, and the DALB and the amplifier AmpA, respectively.

The connection switches SW1, SW2, SW3, and SW4 of the switch group SWGBout connect or interrupt the amplifier AmpB and the source line SLB, the amplifier AmpC and the SLB, the amplifier AmpD and the SLB, and the amplifier AmpA and the SLB, respectively.

The connection switches SW1, SW2, SW3, and SW4 of the switch group SWGCin connect or interrupt the wiring DALC and the amplifier AmpC, the DALC and the amplifier AmpD, the DALC and the amplifier AmpA, and the DALC and the amplifier AmpB, respectively. The connection switches SW1, SW2, SW3, and SW4 of the switch group SWGCout connect or interrupt the amplifier AmpC and the source line SLC, the amplifier AmpD and the SLC, the amplifier AmpA and the SLC, and the amplifier AmpB and the SLC, respectively.

The connection switches SW1, SW2, SW3, and SW4 of the switch group SWGDin connect or interrupt the wiring DALD and the amplifier AmpD, the DALD and the amplifier AmpA, the DALD and the amplifier AmpB, and the DALD and the amplifier AmpC, respectively. The connection switches SW1, SW2, SW3, and SW4 of the switch group SWGDout connect or interrupt the amplifier AmpD and the source line SLD, the amplifier AmpA and the SLD, the amplifier AmpB and the SLD, and the amplifier AmpC and the SLD, respectively.

Figure 3:
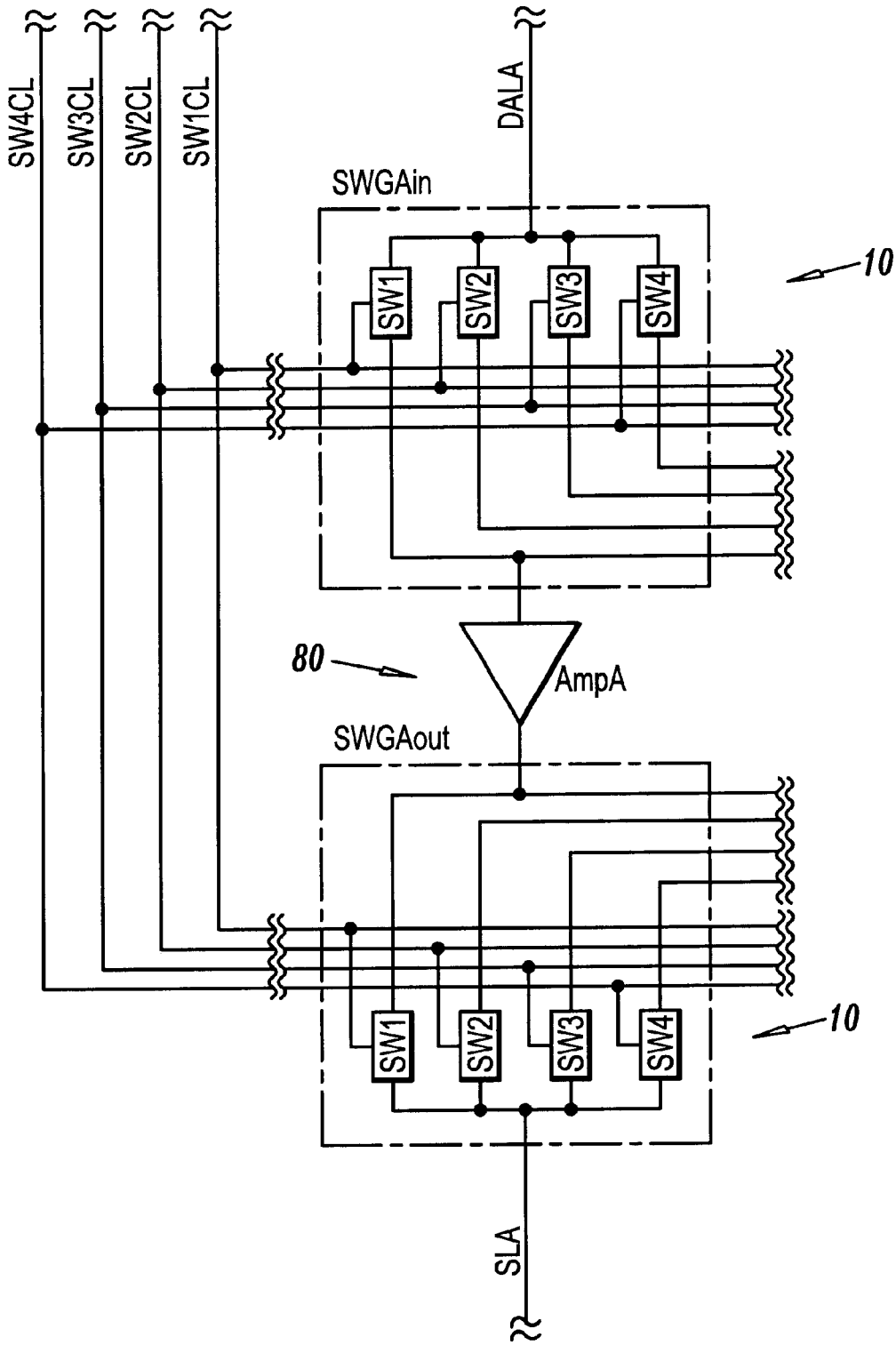
FIG. 3 is a block diagram showing one (AmpA) of the four output amplifiers shown in FIG. 2.

The MOS-FET (metal oxide semiconductor field effect transistor) can be used as the connection switches SW1, SW2, SW3, and SW4, for example. The connection or the interruption of the connection switches SW1, SW2, SW3, and SW4 in switch groups SWGAin, SWGAout, SWGBin, SWGBout, SWGCin, and SWGCout, SWGDin and SWGDout are controlled by control lines SW1CL, SW2CL, SW3CL, and SW4CL. Concretely, the control line SW1CL is connected to each connection switch SW1 of the switch groups SWGAin, SWGAout, SWGBin, SWGBout, SWGCin, SWGCout, SWGDin and SWGDout for controlling the connection or interruption of each switch SW1. Likewise, the control lines SW2CL, SW3CL, and SW4CL are connected to the connection switches SW2, SW3, and SW4 of the switch groups SWGAin, SWGAout, SWGBin, SWGBout, SWGCin, SWGCout, SWGDin and SWGDout for controlling the connection or interruption of the switches SW2, SW3, and SW4, respectively. FIG. 3 shows the connection between switches SW1, SW2, SW3, and SW4 and the connection lines SW1CL, SW2CL, SW3CL, and SW4CL.

Figures 4A, 4B:
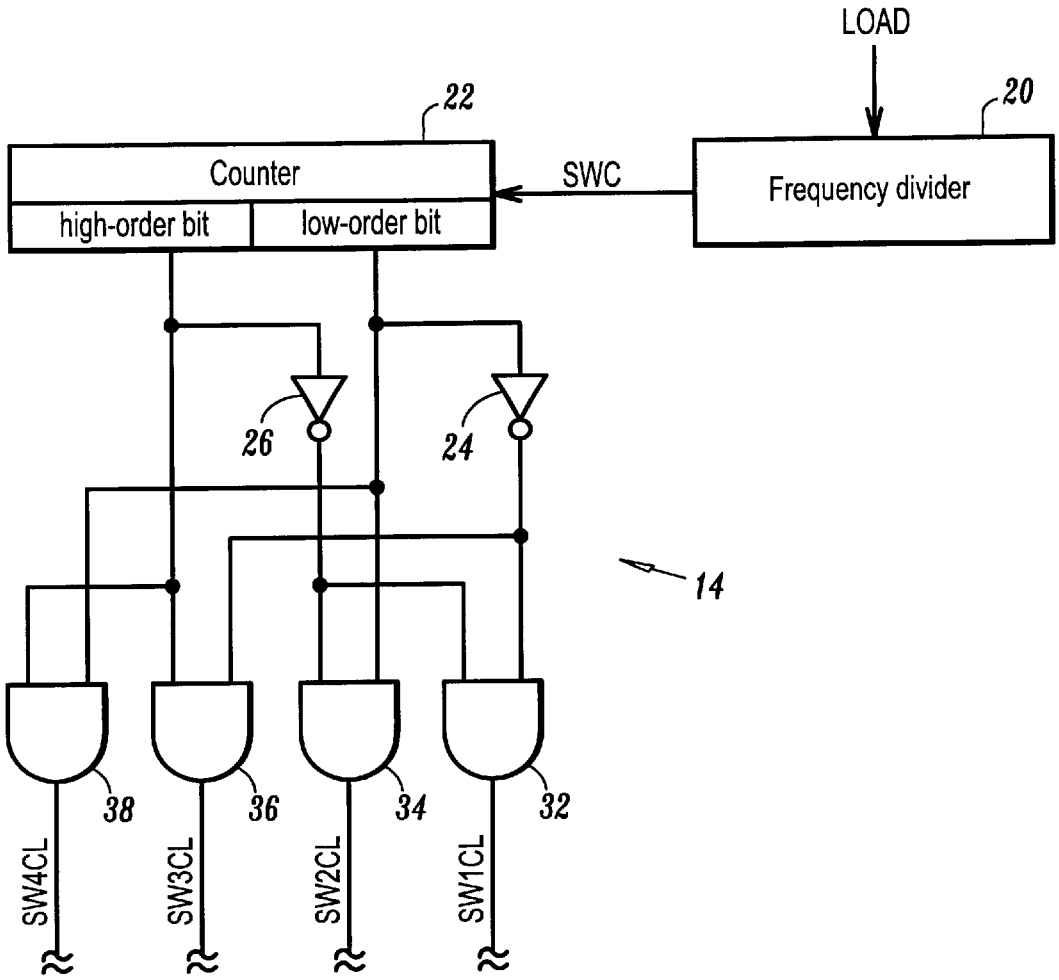
FIG. 4(*a*) is a block diagram showing a part where signals are generated and provided to control lines (SW1CL, SW2CL, SW3CL, and SW4CL) shown in FIG. 2 and FIG. 3, and FIG. 4(*b*) is a table showing signals to be generated.

The signals sent from the control lines SW1CL, SW2CL, SW3CL,and SW4CL to the connection switches SW1, SW2, SW3, and SW4 are generated at a switch controlling section shown in FIG. 4(*a*). The switch controlling section comprises a frequency divider 20, a counter 22, and a decoder 14. The decoder 14 includes four AND circuits 32, 34, 36, 38 and two NOT circuits 24 and 26. The outputs from the AND circuits 32, 34, 36, and 38 are connected to the SW1CL, SW2CL, SW3CL, and SW4CL, respectively. A LOAD signal is input into the frequency divider 20, which outputs a signal SWC once in every n times the LOAD signal is input (n is a positive integer). In this embodiment, the frequency divider 20 outputs the signal SWC every time the scanning of one screen of the liquid crystal panel 70 is completed. The signal SWC is input into the two-bit counter 22.

The counter 22 counts the number of inputs of the signal SWC. However, if the signal SWC is input in the state in which the count number is "11", the count number returns to the state of "00". The lower bit value of the counter 22 is input into the AND circuits 34 and 38, and then it is input into the AND circuits 32 and 36 after being inverted by the NOT circuit 24. The upper bit value of the counter 22 is input into the AND circuits 36 and 38, and then it is input into the AND circuits 32 and 34 after being inverted by the NOT circuit 26. FIG. 4(*b*) shows signals which are output to the control lines SW1CL, SW2CL, SW3CL, and SW4CL in accordance with the upper and lower bit values of the counter 22. Only one of the control lines SW1CL, SW2CL, SW3CL, and SW4CL is activated (the state of "1") in accordance with the count value ("00", "01", "10", "11") of the counter 22. Only one switch (SW1, SW2, SW3, or SW4)

corresponding to the activated control line (SW1CL, SW2CL, SW3CL, or SW4CL) establishes a connection.

Next, an explanation will be given on a function of image display using the above-described source driver for a liquid crystal panel and the method of leveling out output variations of the source driver.

Figure 5:
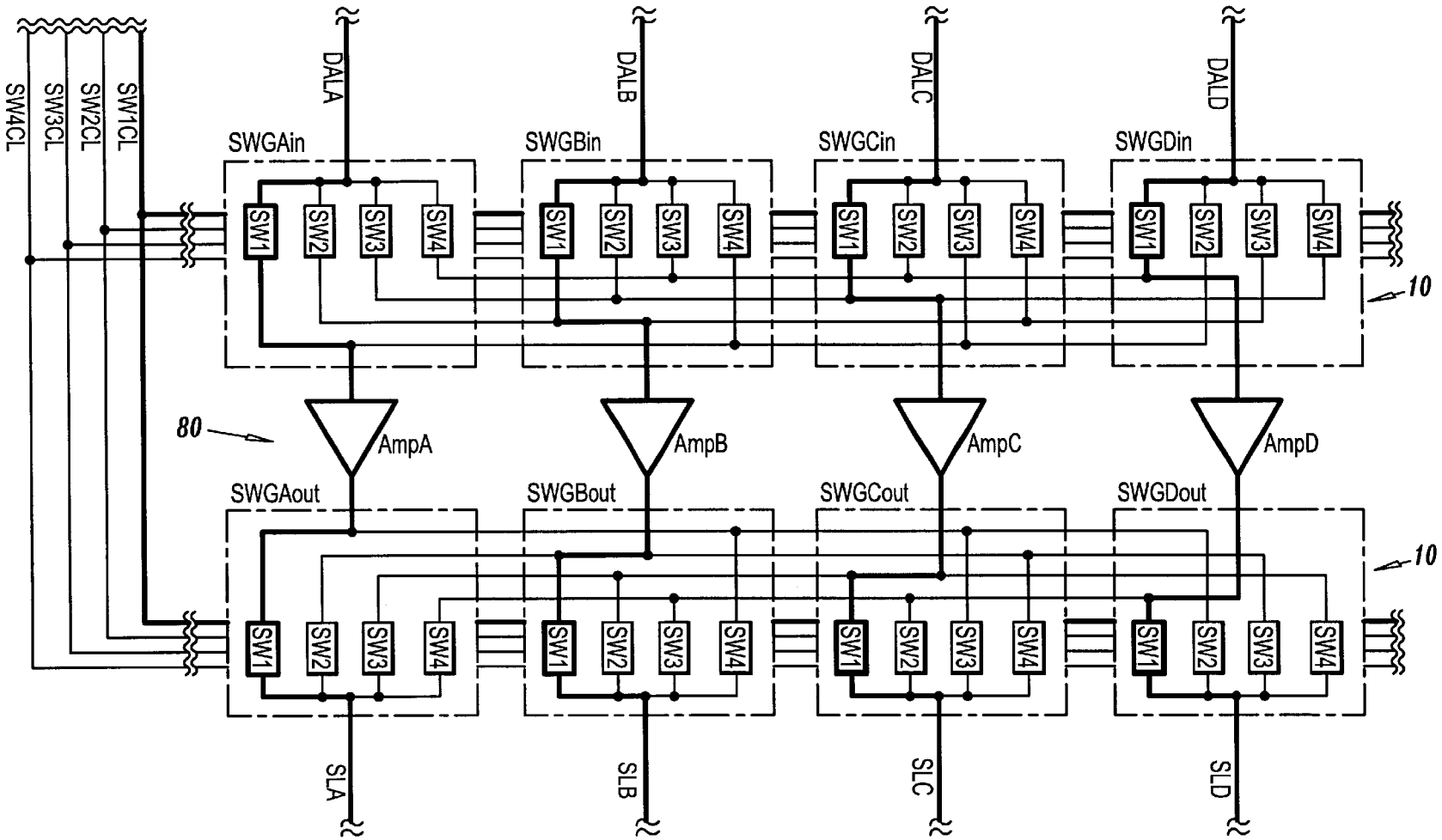
FIG. 5 is a diagram showing the connections of the output amplifiers shown in FIG. 2, when the counter registers "0 0".

If the initial value of the counter 22 is "00", only the control line SW1CL is activated, as shown in FIG. 4(*b*), at the time of initial scanning of one screen. Since only the SW1CL is activated, only the connecting switches SW1 in the switch groups SWGAin, SWGAout, SWGBin, SWGBout, SWGCin, SWGCout, SWGDin, and SWGDout establish connections. Thus, as shown in FIG. 5, the output amplifiers AmpA, AmpB, AmpC, and AmpD are connected to the wiring DALA and the source line SLA, wiring DALB and the source line SLB, wiring DALC and the source line SLC, and the wiring DALD and the source line SLD, respectively. In such a state, each liquid crystal cell is driven.

Figure 6:
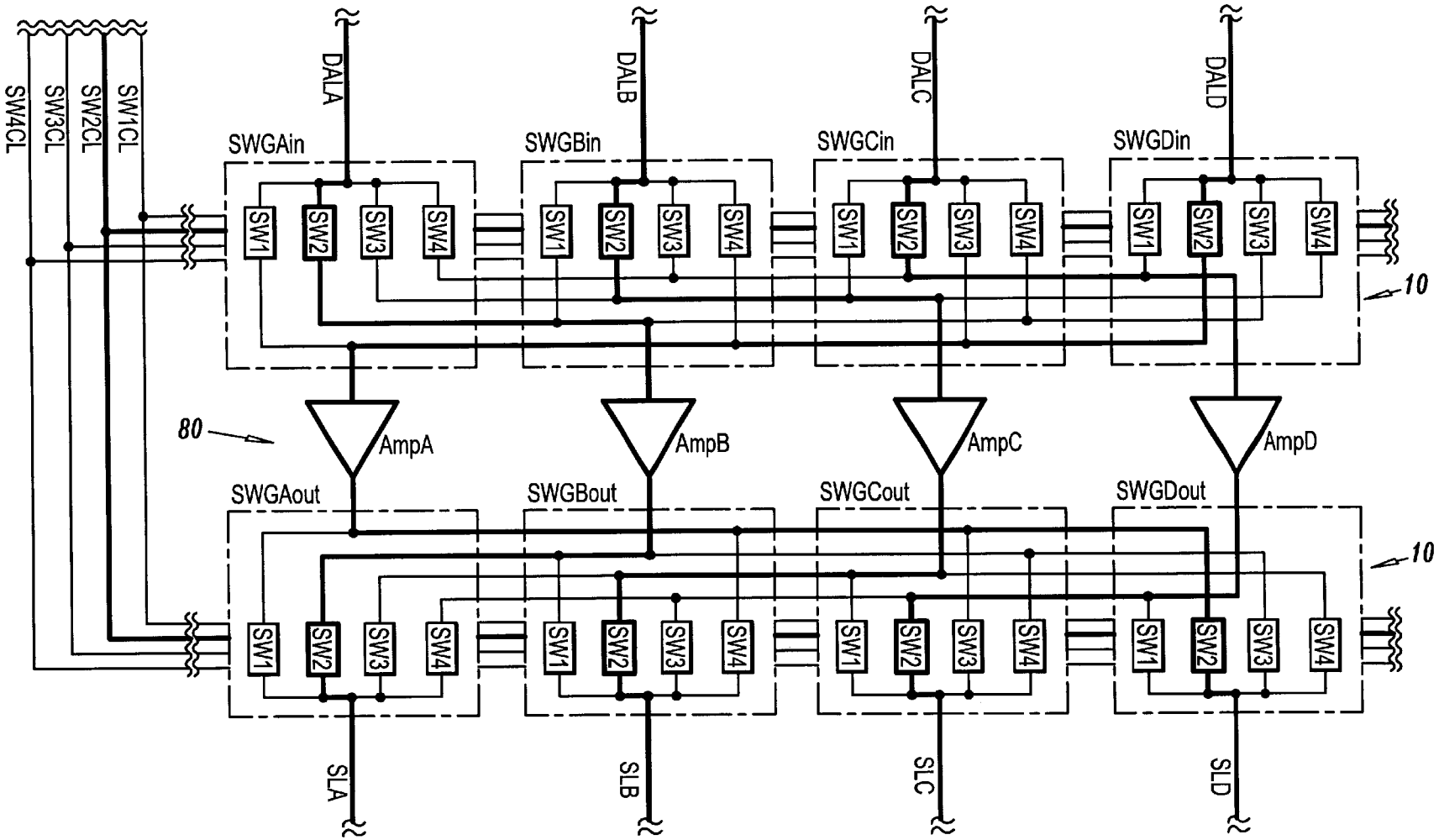
FIG. 6 is a diagram showing the connections of the output amplifiers shown in FIG. 2, when the counter registers "0 1".

After the scanning of one screen is completed, the frequency divider 20 sends a signal SWC to the counter 22, so that the value of the counter 22 increases to "01". When the value of the counter 22 becomes "01", only the control line SW2CL is activated as shown in FIG. 4(*b*). Since only the control line SW2CL is activated, only the connecting switches SW2 in the switch groups SWGAin, SWGAout, SWGBin, SWGBout, SWGCin, SWGCout, SWGDin, and SWGDout establish connections. Thus, as shown in FIG. 6, the output amplifiers AmpB, AmpC, AmpD, and AmpA are connected to the wiring DALA and the source line SLA, wiring DALB and the source line SLB, the wiring DALC and the source line SLC, and the wiring DALD and the source line SLD, respectively, at the time of next scanning of one screen.

In a like manner, every time the scanning of one screen is completed, a signal SWC is input to the counter 22, and any one of control lines SW1CL, SW2CL, SW3CL, and SW4CL is activated in accordance with the count value of the counter 22.

Only one of the connecting switches SW1, SW2, SW3, or SW4 in each of the switch groups SWGAin, SWGAout, SWGBin, SWGBout, SWGCin, SWGCout, SWGDin, or SWGDout establishes a connection. Thus, as shown in FIG. 7, the output amplifiers connected to the wiring DALA and the source line SLA, wiring DALB and the source line SLB, the wiring DALC and the source line SLC, and the wiring DALD and the source line SLD is selectively changed at regular time intervals.

Figure 8A:
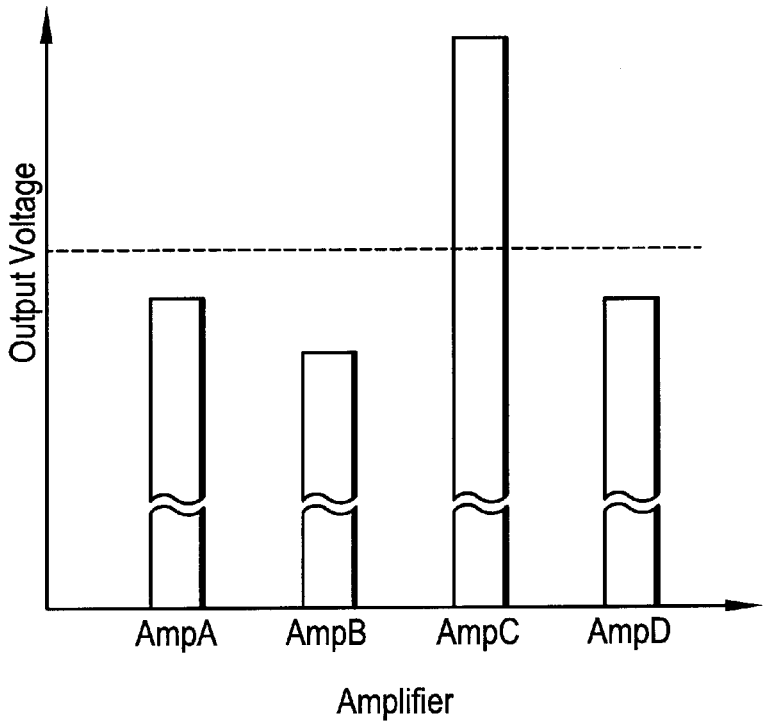
FIG. 8(*a*) is a diagram showing output voltage level of each output amplifier shown in FIG. 2, and FIG. 8(*b*) is a diagram showing voltage level output to each source line shown in FIG. 2.
Figure 8B:
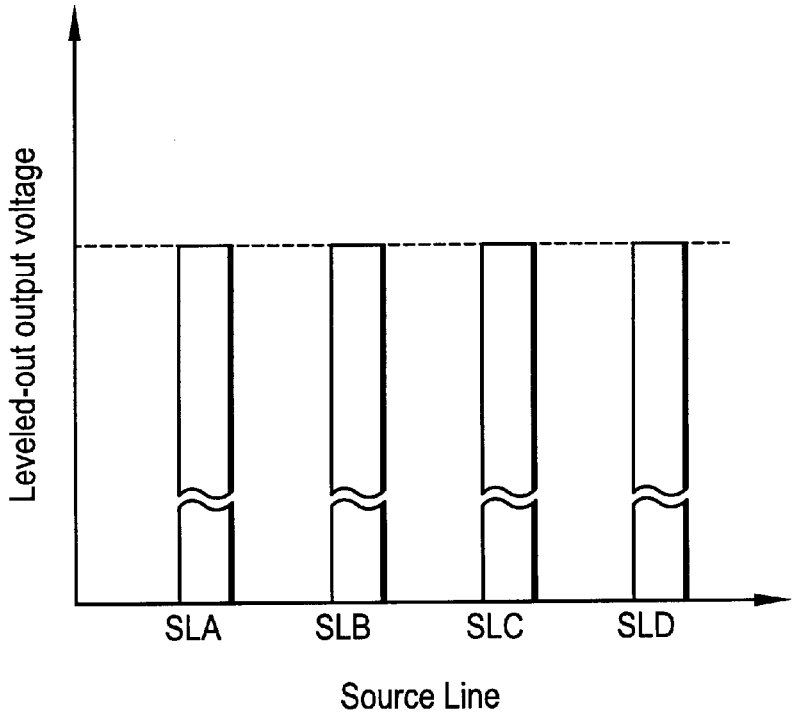

In this way, variations in output voltage due to the difference of gain properties and offset properties of AmpA, AmpB, AmpC, and AmpD can be leveled out by switching among the output amplifiers at regular time intervals. For example, in prior arts, when uniform level of inputs are applied to the output amplifiers AmpA, AmpB, AmpC, and AmpD, variations in output voltages would occur as shown in FIG. 8(*a*). However, in the present invention, the output amplifiers AmpA, AmpB, AmpC, and AmpD are selectively switched at regular time intervals, so that the output voltages of SLA, SLB, SLC, and SLD are obtained by leveling out the output voltages AmpA, AmpB, AmpC, and AmpD as shown in FIG. 8(*b*).

Figure 9A:
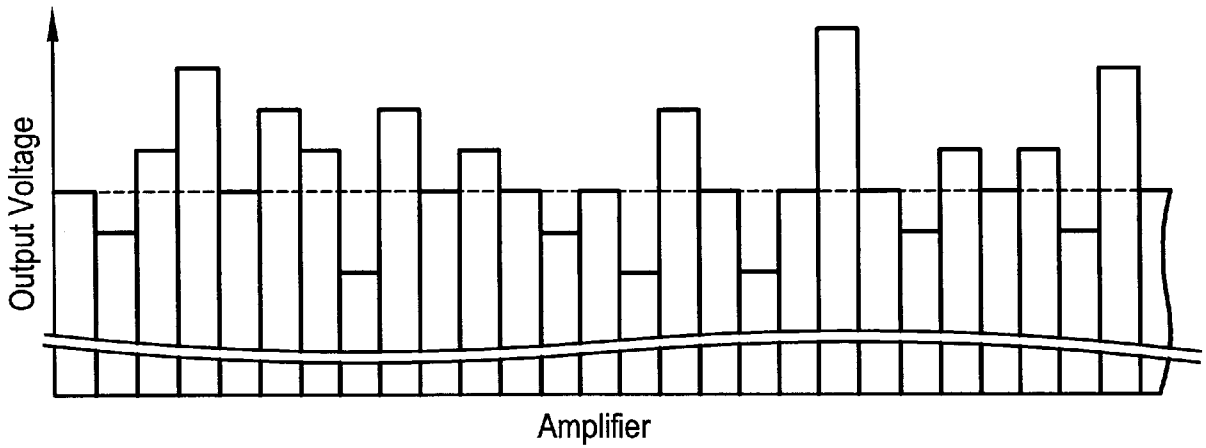
FIG. 9(*a*) is a diagram showing output voltage level of each output amplifier shown in FIG. 1, and FIG. 9(*b*) is a diagram showing voltage level which is output to each source line shown in FIG. 1.
Figure 9B:
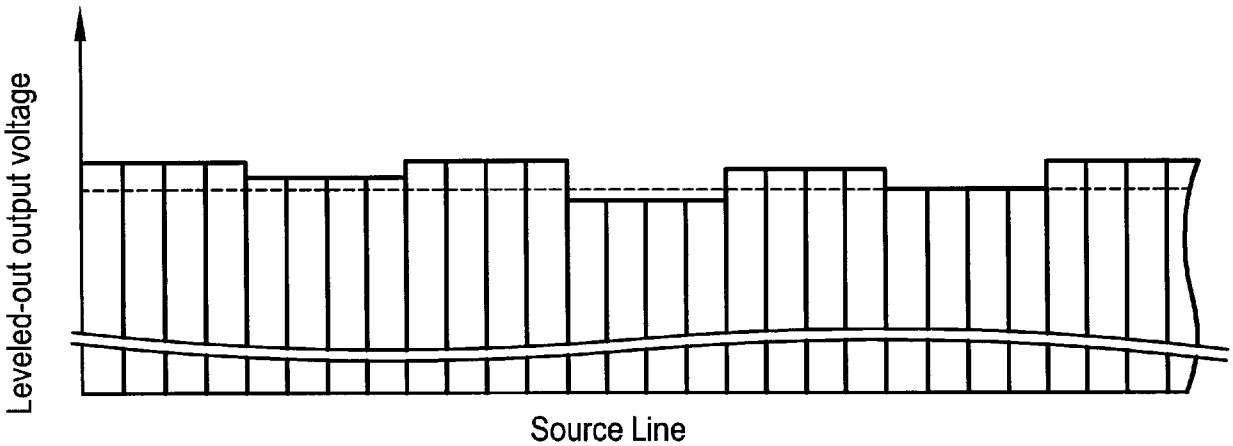
Figure 10:
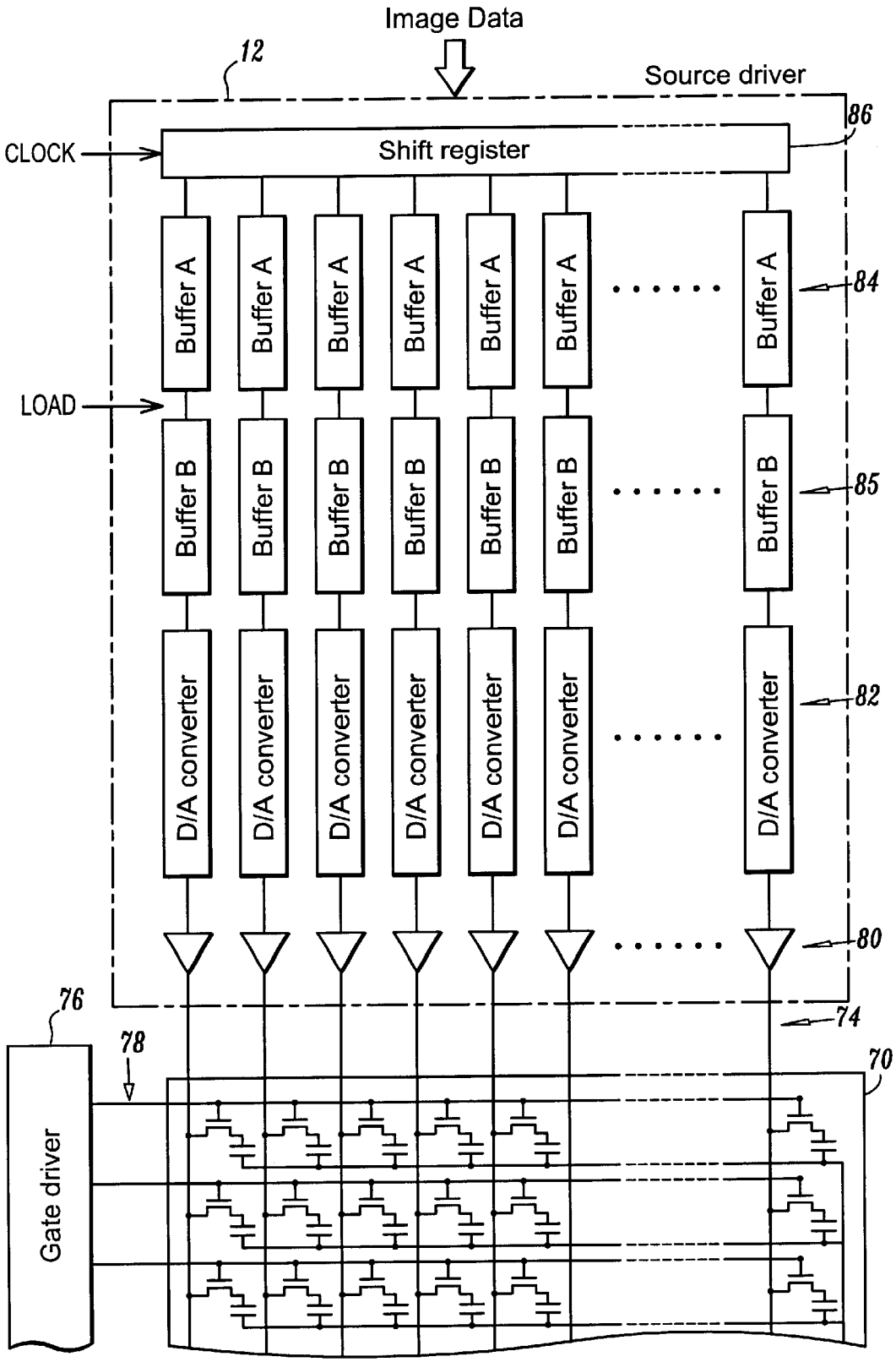
FIG. 10 is a block diagram showing an example of a conventional source driver for a liquid crystal panel.

As in the case of the output amplifiers AmpA, AmpB, AmpC, and AmpD, other output amplifiers 80 in the source driver 12 are also selectively switched. Therefore, even if variations in output voltage of the output amplifier occur as shown in FIG. 9(*a*) when uniform inputs are provided to the source driver 12, output voltages provided to the source lines 74 can be leveled out as shown in FIG. 9(*b*).

In the source driver for a liquid crystal panel and the method for leveling out the variations of output levels of the source driver according to the present invention, connection switches are added between the D/A converter 82 and the output amplifier 80 and between the output amplifier 80 and the source line 74, and switch controlling portions for controlling the connection switch according to the load signals are added to the source driver 72. Since the connection switches are controlled according to the conventionally-used load signals, there is no need making a modification to the input from the outside of the source driver 12.

In the source driver 72 of the present invention, the D/A converters 82 account for about 60% of the total circuit area, the buffers 84 and 85 account for about 30%, and output amplifiers 80 account for about 5%. Since the output amplifiers 80 account for only about 5% of the total circuit area of the source driver, an increase in the circuit area due to the addition of connection switches 10 to the output amplifiers 80 has little effect on the total circuit area of the source driver.

The method for leveling out variations in a source driver for a liquid crystal panel according to the present invention makes it possible to level out variations in output voltage levels caused by the difference in the characteristics of the output amplifiers of a source driver, to provide the leveled output to a source line, and to reduce vertical streak noise on the display screen.

One embodiment of the present invention has been described above, but the present invention can also be materialized in to other embodiments. For example, four adjacent output amplifiers does not always form one group, but two or more adjacent output amplifiers can form one group and can be selectably switched. The source driver of the present invention is not limited to the use for a liquid crystal panel, but it can also be used in a liquid is crystal projector display apparatus.

While the specific embodiments of the present invention have thus been described, it should be understood that the present invention be not limited to this embodiment. Various improvements, modifications, and variations can be made to the embodiments on the basis of knowledge of those skilled in the art without departing from the scope of the present invention.

What is claimed is:

1. A source driver for a liquid crystal panel having a digital/analog converter for converting digital image signal to analog signal and an output amplifier for amplifying the analog signal and providing it to source lines of a liquid crystal panel, comprising:

output amplifier switching means for switching the analog signal to be amplified by the output amplifier to at least one of a plurality of alternate output amplifiers at regular time intervals.

2. The source driver according to claim 1, wherein said output amplifier switching means comprises:

instruction providing means for providing instruction to switch the analog signal to be amplified by the output amplifier to the at least one of a plurality of alternate output amplifiers at regular time intervals; and a switch for switching the analog signal to be amplified by the output amplifier connected between a digital/analog converter and a source line to the at least one of a plurality of alternate output amplifiers connected to at least one of a plurality of alternate digital/analog converters and at least one of a plurality of alternate source lines in accordance with the instruction from the instruction providing means.

3. The source driver according to claim 2, wherein said output amplifiers, source lines, digital/analog converters are divided into groups of n (n is an integer of two or more), and said switch comprises n number of connection switches which are placed between digital analog converters and n number of output amplifiers and between n number of output amplifiers and source lines and which select an output amplifier to be connected to a digital/analog converter and a source line from said n number of amplifiers.

4. The source driver according to claim 3, wherein said instruction providing means comprises;

means for outputting predetermined code signals in succession at regular time intervals; and means for providing instructions to connect or interrupt the n number of connection switches in accordance with the code signals.

5. The source driver according to claim 4, wherein said means for outputting predetermined code signals in succession at regular time intervals comprises a counter for counting the number of times a display screen of a liquid crystal panel is scanned, and said means for providing instructions to connect or interrupt the n number of connection switches in accordance with the code signals comprises a decoder for generating signal which instructs to connect or interrupt the n number of connection switches in accordance with the number of scanning times counted by the counter.

6. The source driver according to claim 3, wherein said connection switches comprises a field effect transistor.

7. A method for leveling out output variations in a source driver for a liquid crystal panel, which comprises a digital/analog converting step for converting digital image signal to analog signal and an amplifying step for amplifying the analog signal and providing it to source lines of a liquid crystal panel, comprising:

an output amplifier switching step for switching the analog signal to be amplified by the output amplifier to at least one of a plurality of alternate output amplifiers at regular time intervals to level out variations in each output amplifier.

8. The method according to claim 7, wherein said output amplifier switching step comprises:

an instruction providing step for providing instruction to switch the analog signal to be amplified by the output amplifier to the at least one of a plurality of alternate output amplifiers at regular time intervals; and a connection switching step for switching the analog signal to be amplified by the output amplifier connected between a digital/analog converter and a source line to the at least one of a plurality of alternate output amplifiers connected to at least one of a plurality of alternate digital/analog converters and at least one of a plurality of alternate source lines in accordance with instructions provided in the instruction providing step.

9. The method according to claim 8, wherein said output amplifiers, source lines, and digital/analog converters are divided into groups of n (n is an integer of two or more), and said connection switching step comprises a step of selecting an output amplifier to be connected to a digital/analog converter and a source line from said n number of amplifiers by using n number of connection switches placed between digital analog converters and n number of output amplifiers and between n number of output amplifiers and source lines.

10. The method according to claim 9, wherein said instruction providing step comprises the steps of:

outputting predetermined code signals in succession at regular time intervals; and providing instructions to connect or interrupt the n number of connection switches in accordance with the code signals.

11. The method according to claim 10, wherein said step of outputting predetermined code signals in succession at regular time intervals comprises a counting step of counting the number of times a display screen of a liquid crystal panel is scanned, and said step of providing instructions to connect or interrupt the n number of connection switches in accordance with the code signals comprises a step of generating signal which provides instructions to connect or interrupt the n number of connection switches in accordance with the number of scanning times counted in the counting step.

* * * * *